US009922511B2

(12) United States Patent
Bomparet

(10) Patent No.: US 9,922,511 B2
(45) Date of Patent: Mar. 20, 2018

(54) FENCE WITH LOCALIZED INTRUSION DETECTION

(75) Inventor: Bruno Bomparet, Lyons (FR)

(73) Assignee: SOCIETE RHODANIENNE D'ELECTRONIQUE APPLIQUEE-SORHEA, Valux-en-Velin (FR)

( * ) Notice: Subject to any disclaimer, the term of this patent is extended or adjusted under 35 U.S.C. 154(b) by 1265 days.

(21) Appl. No.: 13/882,498

(22) PCT Filed: Oct. 24, 2011

(86) PCT No.: PCT/FR2011/052476

§ 371 (c)(1),
(2), (4) Date: Jul. 9, 2013

(87) PCT Pub. No.: WO2012/056156

PCT Pub. Date: May 3, 2012

(65) Prior Publication Data

US 2013/0304415 A1 Nov. 14, 2013

(30) Foreign Application Priority Data

Oct. 29, 2010 (FR) ..... 10 04281 A
Nov. 22, 2010 (FR) ..... 10 04529 A

(51) Int. Cl.
*G08B 13/18* (2006.01)
*G08B 13/12* (2006.01)

(52) U.S. Cl.
CPC ..... *G08B 13/12* (2013.01); *G08B 13/122* (2013.01)

(58) Field of Classification Search
USPC ..... 340/506, 635; 370/424
See application file for complete search history.

(56) References Cited

U.S. PATENT DOCUMENTS 4,097,025 A 6/1978 Dettmann et al.
4,482,890 A 11/1984 Forbes et al.
(Continued)

FOREIGN PATENT DOCUMENTS

CZ 17936 U1 10/2007
DE 202007017709 U1 2/2008
(Continued)

OTHER PUBLICATIONS

French Search Report dated Jul. 28, 2011, corresponding to FR 10 04529.

(Continued)

*Primary Examiner* — Lam Nguyen
(74) *Attorney, Agent, or Firm* — Ladas & Parry LLP

(57) ABSTRACT

The invention relates to a system for detecting and locating an attempted intrusion into a perimeter defined by a fence. The invention comprises a management unit (UG), impact or vibration detectors (D), and a station (P) for processing data (UG). According to the invention: each detector is connected on one side to another detector and on the other side either to another detector or a management unit; each detector transmits data to the detector(s) and/or management unit to which it is directly connected; each detector receives data from the detector(s) and/or management unit to which it is connected; and a detector that receives data on one side transmits said data to the detector or management unit to which it is connected on the other side, in addition to transmitting data about events that it has detected.

16 Claims, 5 Drawing Sheets

(56) References Cited

U.S. PATENT DOCUMENTS

| | | | | |
|---|---|---|---|---|
| 4,829,287 | A | | 5/1989 | Kerr et al. |
| 5,031,095 | A | * | 7/1991 | Hara ..... G06F 15/17337 370/424 |
| 5,068,642 | A | | 11/1991 | Hruby et al. |
| 5,194,847 | A | | 3/1993 | Taylor et al. |
| 5,446,446 | A | | 8/1995 | Harman |
| 5,448,222 | A | | 9/1995 | Harman |
| 5,914,655 | A | * | 6/1999 | Clifton ..... G08B 29/186 340/506 |
| 2010/0201561 | A1 | | 8/2010 | Dhondt et al. |

FOREIGN PATENT DOCUMENTS

| | | | |
|---|---|---|---|
| EP | 0733250 | A1 | 9/1996 |
| EP | 0908859 | A1 | 4/1999 |
| FR | 2860092 | A1 | 3/2005 |
| FR | 2905023 | A1 | 2/2008 |
| FR | 2930843 | A1 | 11/2009 |
| WO | 2007117579 | A1 | 10/2007 |
| WO | 2008071780 | A2 | 6/2008 |
| WO | 2009022286 | A2 | 2/2009 |

OTHER PUBLICATIONS

International Search Report dated Feb. 17, 2012, corresponding to PCT/FR2011/052476.

* cited by examiner

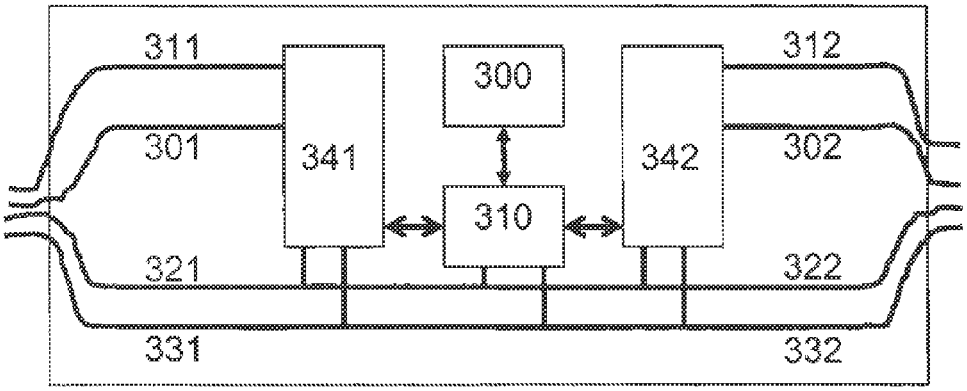
Figure 7
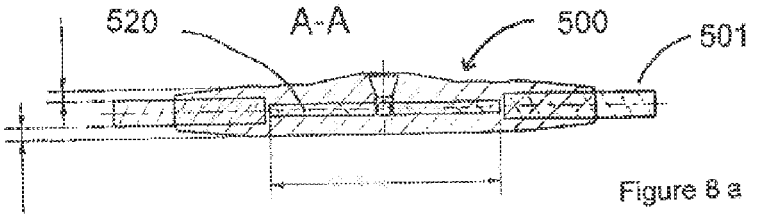
Figure 8 a
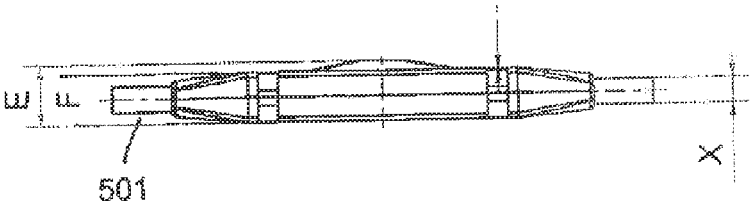
Figure 8 b
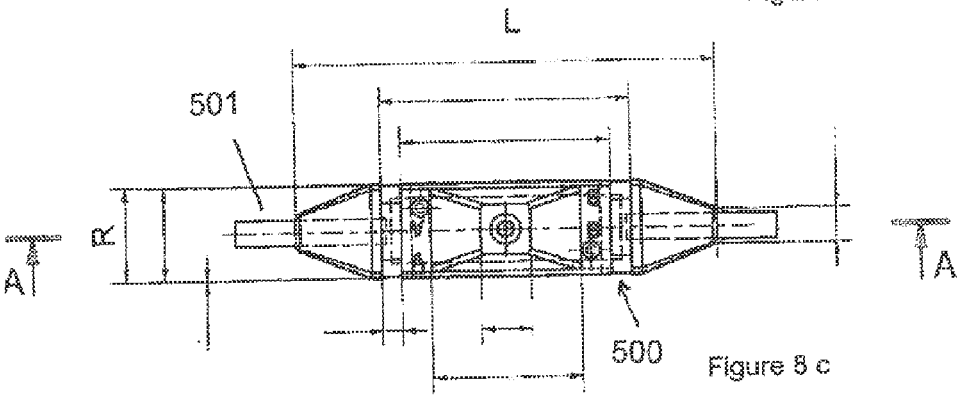
Figure 8 c
Figure 8

FENCE WITH LOCALIZED INTRUSION DETECTION

This application is a 371 of PCT/FR2011/052476, filed on Oct. 24, 2011, which claims priority to French Patent Application No. 1004281, filed Oct. 29, 2010, and French Patent Application No. 1004529, filed Nov. 22, 2010.

FIELD OF THE INVENTION

The invention relates to the technical field of protective fences for detecting and locating an attempted intrusion into a perimeter defined by the fence. It particularly relates to a detection system suitable for being mounted onto fences consisting of an assembly of panels and posts, and comprising a plurality of detectors, particularly vibration detectors or accelerometers, mounted on the panels.

STATE OF THE RELATED ART

A protective fence comprises fixing posts between which fence elements, at least partially defining an enclosure or perimeter, extend. The fence elements may be rigid, semi-rigid or flexible and form a physical barrier for preventing a person from entering the defined perimeter.

To detect an intrusion or attempted intrusion, various approaches are used. A light barrier running parallel with the fence, typically behind the fence (i.e. inside the enclosure) or radar detection may be used. Acoustic or optical detectors may also be used, such as infrared detectors or motion detectors, or surveillance cameras, optionally associated with an image processing system. However, these approaches become very unwieldy if it is sought not only to detect but also locate the intrusion. Indeed, the length of fences may be up to several kilometers and, as such, it is desirable to be able to locate the intrusion accurately and automatically, particularly before any human intervention.

The most widespread approach for locating intrusion in extra long fences makes use of horizontal wires, parallel with the fence, which are connected to individual sensors detecting the movement or vibrations thereof, or themselves incorporating detection means. These wires may be incorporated in the fence; the individual sensors may be incorporated in the fence elements or in the posts. These wires are called "shock cables". Various detection techniques are known; they are explained for example in the introductory part of the U.S. Pat. No. 5,446,446.

The detectors and detection systems need to be robust and withstand variations in weather conditions and adverse weather conditions. They should detect any attempted human intrusion, but rain, hail or wind, small animals or leaves touching the cable or causing said cable to vibrate should not trigger false alerts. Similarly, nearby road traffic (for example, a truck passing at a high speed) should not disturb the detection system.

The U.S. Pat. No. 5,446,446 and U.S. Pat. No. 5,448,222 (Southwest Microwave, Inc.) describe a cable comprising a tubular conductor and a wire conductor which are coaxial and separated by a non-magnetic dielectric wherein a conduit comprising a detection cable is provided, capable of moving freely within the conduit; the movement of the shock cable induces the movement of the detection cable, resulting in a change of impedance which is detected by a detection system using a radiofrequency signal transmitted by the tubular conductor. The location method is based on analyzing the disturbance of a periodic radiofrequency pulse by the intrusion, which is detected by the pulse reflected at the end of the cable. In this system, which is a reference product on the current market, any failure of the radiofrequency system (for example following a cut in the cable) is difficult to diagnose and locate.

The U.S. Pat. No. 4,097,025 (Electronic Surveillance Fence Security) describes a system comprising an equivalent system to a shock cable, i.e. a tube parallel with the fence and attached thereon, which transmits any vibration to a unit situated on the fence and comprising a piezoelectric vibration detector. This tube is capable of transmitting a relatively broad spectrum of vibrations, which may then be converted into electrical signals and analyzed. The tube contains a conventional coaxial cable interconnecting the units; this cable comprises two conductors, i.e. one central conductor and one meshed outer shielding conductor. For the management of the signals generated by the detectors, the latter are placed in groups. Each signal is amplified by an operational bandwidth amplifier and if the signal exceeds a predefined amplitude threshold, a square pulse is generated, then integrated and amplified further. The output of this amplifier is connected to the coil of a reed relay which generates an electrical signal. Each group sends the electrical signals generated to a common reed relay. If the signal exceeds a predefined value, the relay opens, triggering an intrusion alert. A further circuit makes it possible to locate the group wherein the intrusion took place. This system is not suitable for locating the intrusion per se; the patent suggests adding microphones enabling a guard to listen to what is happening in the area wherein the alert was triggered.

The Czech utility model CZ 17936 U1 describes a system based on mechanical vibration sensors mounted on fence panels between posts. Each sensing detector has a unique address and is connected to a digital data bus and to an evaluation unit input communication circuit. The data management system compares the signals produced by two adjacent sensors. The evaluation unit continuously compares the level of motion from all the detectors on the fence, and if, between some of the detectors, a difference in the values measured exceeding a predefined limit is detected, this status is signaled by activating the analog output circuit. No details are given on the method for connecting the detectors to the evaluation unit, on the data transmission method, on the method for analyzing data or on the concrete implementation thereof. For this reason, it is not possible to evaluate the performances, limitations, advantages and drawbacks of such a system.

There is a clear need for alternative systems, which are particularly suitable for extra long fences, in the region of several kilometers. For practical reasons, over such lengths, it is no longer possible to do away with accurate location of the alert before launching a visual investigation by a surveillance camera or a human guard. Moreover, the system needs to be highly reliable, both in respect of false alerts and in respect of easy malfunction detection.

AIMS OF THE INVENTION

A first aim of the invention is a system for detecting and locating an attempted intrusion into a perimeter defined by a fence, said fence comprising retention elements and ground securing elements such as posts, said detection and location system comprising (i) at least one management unit (UG), (ii) a plurality of means (D) for detecting impacts and/or vibrations liable to occur on said fence, interconnected via a so-called detection cable, said detection cable being connected to said at least one management unit (UG), (iii) a station (P) for processing data connected to at least one of said management units (UG), (iv) means for transmitting data from at least one of said management units (UG) to the data processing station (P), (v) optionally, one or a plurality of terminal units (T) for terminating a free end of said detection cable, said system being characterized in that each detection means (Dn) is directly connected (optionally via a connection unit) on one side to another detection means (Dn+1 or Dn−1) and on the other side:

either to another detection means (Dn+1 or Dn−1), or to a management unit (UG), or to a terminal unit (T); and each detection means (Dn) transmits data in digital signal frame format to the detection means (Dn+1 and/or Dn−1) and/or to the management unit (UG) to which it is directly connected;

each detection means (Dn) receives data in digital format from the detection means (Dn+1 and/or Dn−1) and/or to the management unit (UG) to which it is directly connected;

a detection means (Dn) that receives data on one side transmits said data to the detection means (Dn+1 or Dn−1) or management unit (UG) to which it is directly connected on the other side; and each detection means (Dn) transmits data in digital format about events that it has detected to the detection means (Dn+1 or Dn−1) or management unit (UG) to which it is directly connected.

The system may comprise a plurality of detection cables.

Each detection means (Dn) (also referred to as a "detector") comprises a sensor. The sensors may be of any type, but vibration sensors or accelerometers, which detect and measure a vibration in the three spatial directions, are preferred. According to the invention, each detector has a specific signal processing algorithm and is capable of performing auto-calibration.

According to an essential feature of the present invention, each detector is capable of transmitting data to each of the two directly adjacent units thereof (detector or management unit) and of receiving data from each of the two directly adjacent units thereof. For this purpose, each detector has, in each of the two directions of the cable, a transmission channel and a reception channel. There is no direct data link between a detector and a management unit, i.e. a data link that does not pass through another detector, except for the detector directly connected to a management unit. The inventors found that this simplifies the interfacing in the case of extra long systems by avoiding unique addressing of each detector. Given that the detector (Dn) is connected to the detectors (Dn+1)/(Dn−1) or (Dn+1)/(UG) or (Dn−1), it is not necessary to have unique addresses for all the detectors installed on the perimeter. Only the differentiation of detectors belonging to a detector cable is required. For this reason, all the detector cables are identical and the number of detector cables on the same site can be multiplied without having to manage an increase in the number of addresses. This avoids differentiating each detector of the entire site, enables easier maintenance (replacement of one or a plurality of detectors) and, finally, makes it possible to manage all the detectors with a very simple communication protocol which thus has a low energy consumption since it is only requires little calculation. Moreover, the simplicity of this protocol makes it possible to work with low transmission speeds (between 9600 Baud and 19,200 Baud), which are thus reliable and have a low energy consumption.

In one advantageous embodiment, each detection means (Dn) comprises two interfaces, one on either side of the detection means, each of these interfaces having a transmission channel and a reception channel for receiving and transmitting data from another (or to another) detection means (Dn+1 or Dn−1) or from (or to) a management unit (UG) to which said detection means (Dn) is directly connected.

Each of said interfaces comprises at least three buffer memories suitable for storing at least one byte of the signal frame, i.e.:

(i) a first reception buffer memory for each interface, wherein the byte or one of the bytes of the frame currently being received is stored;

(ii) a second transmission buffer memory for each interface, wherein the byte or one of the bytes of the frame currently being transmitted is stored;

(iii) a third intermediate buffer memory for each interface which acts as a link between the reception channel on one side and the transmission channel on the other side.

In such a system, the frame, byte by byte, received by the reception channel is received in the reception buffer memory, transferred to the intermediate buffer memory acting as a link with the transmission channel and then transferred to the transmission buffer memory to be transmitted by the transmission channel.

Advantageously, each management unit (UG) has a standalone electrical power supply, preferably a photovoltaic cell or a wind generator associated with a battery, or a fuel cell. This avoids having to provide a mains power supply buried underground or with visible mains cables. The management unit (UG) supplies the detection means (Dn) with electricity. Advantageously, the number of detection means powered and managed by each management unit is not more than eighty, i.e. forty on either side. More specifically, advantageously, each detection cable comprises not more than forty detectors, and each management unit manages not more than two detection cables.

In one particular embodiment of the system according to the invention, one or a plurality of management units are connected to external detectors and/or to external alarms. For example, these may consist of presence detectors situated behind the fence (i.e. inside the enclosure) or heat detectors. As such, it is advantageous for each management unit to have one or a plurality of inputs for signals from an external detector with respect to the detector cable.

In the system according to the invention, a plurality of circuit layouts may be used, particularly closed or open loops. The system may form a plurality of detection zones.

The data processing station (P) is a remote station centralizing the alerts and comprising means for recording and viewing same; preferably, viewing the alerts comprises the location thereof on a map representing the protected perimeter, so as to be readily understood by a human guard.

Advantageously, the detectors are integrated in a cable referred to as a detector cable. More specifically, a detector cable comprises a plurality of integrated detectors, preferably arranged with constant spacing, preferably each located in an elongated sealed housing, the length whereof is parallel with the cable. This unit may be made for example of plastic or rubber, particularly by means of molding. The unit may be integrated in the cable sheath, providing said detector cable with high mechanical strength (particularly tensile strength) and complete sealing.

Preferably, the same detector cable comprises not more than forty detectors. The ends of the detector cable are provided with connectors suitable for being connected either to a management unit, or to a connection unit to another detector cable (particularly if the fence forms an angle), or to a terminal unit. Any cable end not ending either with a management unit or with a connection unit should be connected to a terminal unit.

In this way, the second aim of the invention is a detector cable for use with the system according to the invention, comprising a plurality of detection means (Dn), preferably identical, and preferably with spacing between two adjacent detection means which is substantially equal, and connection means at each of both ends thereof, each detection means being preferably an impact and/or vibration detector, and each detector comprising two interfaces, i.e. one on each side of the detection means, and said detector cable being characterized in that each detection means (Dn), each of said interfaces has a transmission channel and a reception channel suitable for transmitting and receiving data to (or from) another detection means (Dn+1 or Dn−1) or to (or from) a management unit (UG) to which said detection means (Dn) is, in operation, directly connected, and in that each of said interfaces comprises at least three buffer memories suitable for storing at least one byte of the signal frame, i.e.:

- a first reception buffer memory for each interface, wherein the byte or one of the bytes of the frame currently being received is stored;
- a second transmission buffer memory for each interface, wherein the byte or one of the bytes of the frame currently being transmitted is stored;
- a third intermediate buffer memory for each interface which acts as a link between the reception channel on one side and the transmission channel on the other side.

According to the invention, the spacing between two detection means in the system and in the cable is advantageously between 2 m and 4 m. Advantageously, the number of detection means is not more than 140 (typically for a cable length in the region of 350 m), since, accounting for the advantageous spacing between the detection means and the voltage drop associated with the ohmic resistance of the cable, it would thus be necessary to increase the cable cross-section, which would render same heavy and difficult to handle during assembly. Advantageously, not more than 80 detector means, or more advantageously not more than 40, are provided, given that the increase in the number of management units does not pose a practical problem.

The third aim of the invention is a method for detecting and locating a cut in a detection cable according to the invention of a detection system according to the invention, wherein:

- the management unit (UG) periodically transmits a query in the form of at least one byte frame (referred to as a "query frame") to the detection means to which it is directly connected;
- each detection means (Dn) transmits this query frame to the next adjacent unit, which may be either another detection means (Dn+1) or a management unit (UG), or a terminal unit;
- in response to the query, the management unit (UG) expects to receive the same query frame as that transmitted and comprising the sequential number of the last detection means belonging to the detection cable connected to the management unit (UG), and wherein said method particularly comprises the following steps:

- the reception of said at least one query frame by said next adjacent unit of said detection means (Dn) triggers the transmission of an acknowledgement frame to the sender;
- if the detection means (Dn) has not received the acknowledgement frame from the next adjacent unit (Dn+1) thereof, said detection means (Dn) transmits the query frame received to the preceding adjacent unit (Dn−1) and the management unit (UG) finally receives the same query frame as that transmitted, but observes that the sequential number of said query frame is in this case (Dn) and not the sequential number of the final detection means of the cable;
- the management unit UG then decides that the cable is cut between the detection means (Dn) and the detection means (Dn+1).

The method described above is suitable for locating the cut in the detector cable. The frame transmitted periodically by the management unit (UG) expects in return the integrity of all the detectors present on the detector cable. This integrity is verified in that each detector (Dn) modifies the sequential number registered in the query frame with the sequential number thereof: the detector (Dn) registers n, the detector (Dn+1) registers n+1 instead of n, up to the detector ending the cable. The number of the detector ending the detector cable has been previously stored in memory during a system configuration procedure by the management unit (UG) to which the detector cable is connected. If a return from the query frame contains the sequential number corresponding to that stored in memory during configuration, this means that the detector cable is intact, i.e. that all the constituent detectors thereof are present and operational.

If the cable is cut or damaged or if a detector is no longer working, the detector (Dn−1) located immediately before the cut or the damaged detector will not receive the acknowledgement in response to the transmission of the query frame following a query from the management unit (UG). In this case, the detector (Dn) returns the frame in the other direction by transmitting same to the detector (Dn−1) in relation to the position thereof. The management unit (UG) will see the frame return with a different sequential number to that stored in memory and thus will report the cut or damage of the detector cable with the knowledge of the sequential number of the detector situated immediately before the cut or damage of the detector cable.

A second method is suitable for locating attempted intrusions. This second method is added to the first and is completely asynchronous in respect of the first.

Each detector, detecting motion in relation to the fence (vibration, impact, etc.) using the integrated sensor, spontaneously generates a frame referred to as an event frame which is transmitted to the detector (Dn+1) and (Dn−1) or (Dn+1) and (UG) or (Dn−1) and (UG). A set of detectors may simultaneously each generate the event frame thereof comprising the sequential number thereof and a data item or parameter Z characterizing (representing) the physical parameter measured by the sensor representing the vibration or impact detected.

The management unit to which the detector cable is connected comprising the detector(s) having transmitted the event frame thereof analyzes the set of event frames received according to criteria such as: number of adjacent detectors having transmitted a frame in a predetermined time interval, the detector having detected the greater variation in vibration and the presence of a specific signature i.e.: a minimum followed by a maximum followed by a minimum or a minimum and a maximum corresponding to variations in vibrations detected by different and adjacent detectors. If the criteria consist of an alarm then the management unit (UG) generates an alarm frame. The precise location is determined by the number of the detector having generated the maximum value of the parameter Z.

A fourth aim of the invention is thus a method for detecting and locating an attempted intrusion into a perimeter defined by a fence comprising the detection system according to the invention and preferably at least one detection cable according to the invention, wherein:

each detection means (Dn), detecting motion in relation to the fence using the integrated sensor, spontaneously generates a frame referred to as an event frame which is transmitted to each of the direct adjacent units thereof, i.e. the next (Dn+1) and previous (Dn−1) detection means or to the detection means (Dn+1) and to the management unit (UG) or to the detection means (Dn−1) and to the management unit (UG), said event frame comprising at least one parameter Z which is a representation of at least one physical parameter measured by the sensor of said detection means (Dn);

the management unit (UG) to which the detector cable is connected comprising the detector(s) having transmitted the event frame thereof analyzes the set of event frames received and decides whether to generate an alarm frame, given that the precise location of the event is determined by the number of the detector having generated the maximum value of said parameter Z.

BRIEF DESCRIPTION OF THE DRAWINGS

FIG. 7 shows another electrical diagram of a detector used in the invention.

FIG. 8*a* shows a first view of a detector used in the invention.

FIG. 8*b* shows a second view of a detector used in the invention.

FIG. 8*c* shows a third view of a detector used in the invention.

DETAILED DESCRIPTION

In order to detect any attempted intrusions liable to occur on a fence, a detector cable is installed thereon, characterized in that it is sensitive to the panels being cut, climbed or extracted.

This cable consists of a set of detectors distributed evenly (i.e. substantially equidistantly) along the cable. Preferably, the detectors are an integral part of the cable, i.e. the cable and the detectors form a single element. Preferentially, each detector detects the variations in motion in the three spatial directions of the supporting member wherein it is installed. Each detector comprises a sensor, such as a vibration sensor or an accelerometer, and the electronic components required and suitable for use for measured signal management, for communication and for the electrical power supply.

The invention is explained with reference to FIGS. 1 to 9 illustrating embodiments of the invention, but not limiting the scope of the invention.

Figure 1:
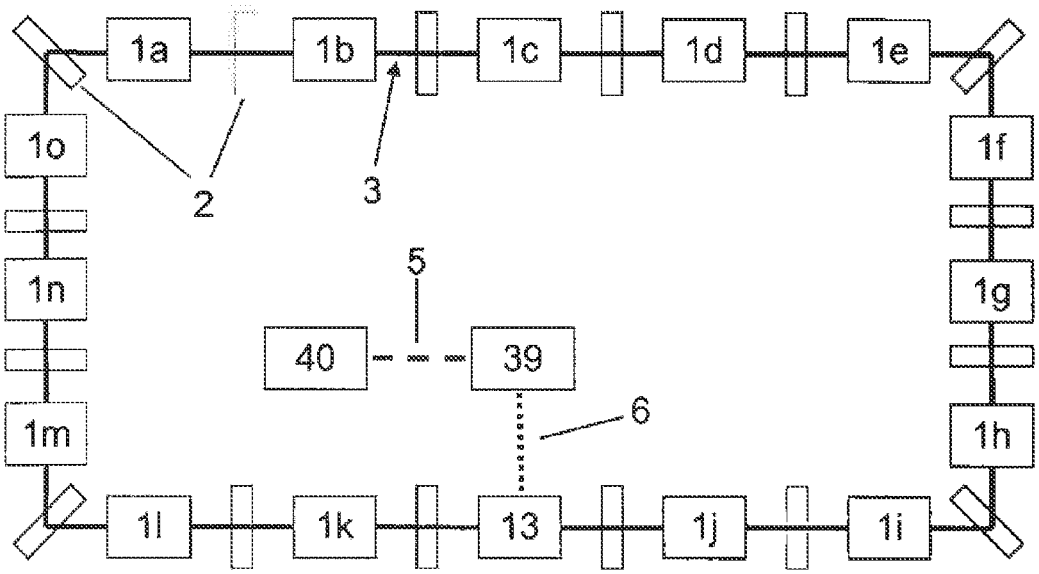
FIG. 1 shows a fence according to the invention, forming a closed loop.

FIG. 1 shows a fence comprising a plurality of detection means each comprising a detector (1*a* to *o*) mounted on fence elements mounted on posts 2. All the detectors are connected by a cable 3. A management unit 13 is connected to the detector cable so as to close a loop. It transmits data to a concentrator 39, which is connected to a computer 40; the concentrator is a management unit referred to as a gateway management unit. The fence forms an enclosure. The link 6 between the gateway management unit 13 and the concentrator 39 is provided for example via an RS485 interface. The link 5 between the concentrator 39 and the computer 40 is provided for example via RJ45 Ethernet.

In one particular embodiment of the system, all the management units are equipped to act as a gateway management unit; this gives the installer of the detection cable more flexibility.

Figure 2:
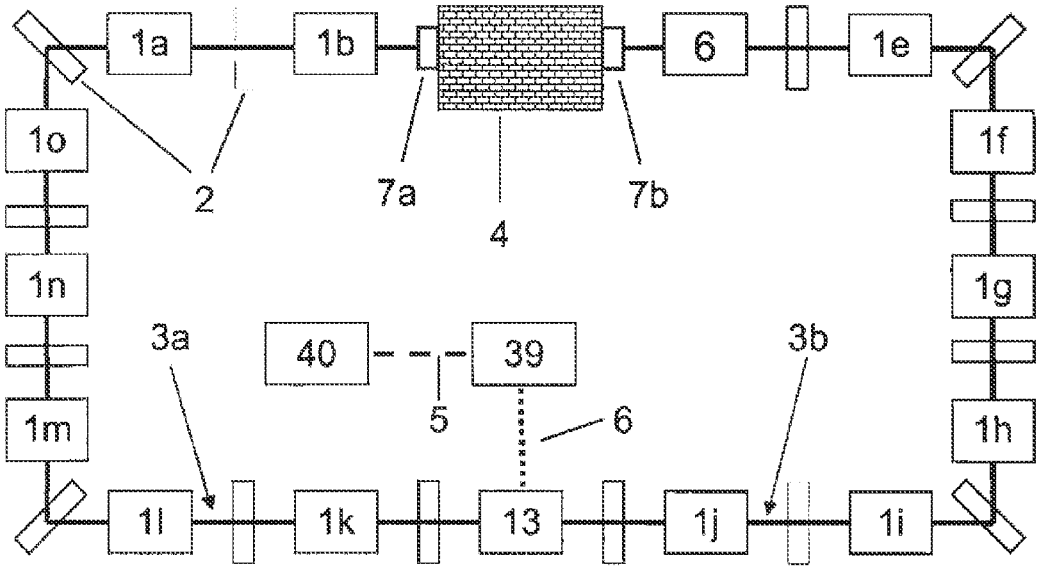
FIG. 2 shows a fence according to the invention, forming an open loop that includes an obstacle.

FIG. 2 shows an alternative of this embodiment, wherein the fence does not form a closed loop, but includes an obstacle (building or gate 4). For this reason, the system comprises two detector cables 3*a,b*, each of which ends with a terminal unit 7*a,b*.

Figure 3:
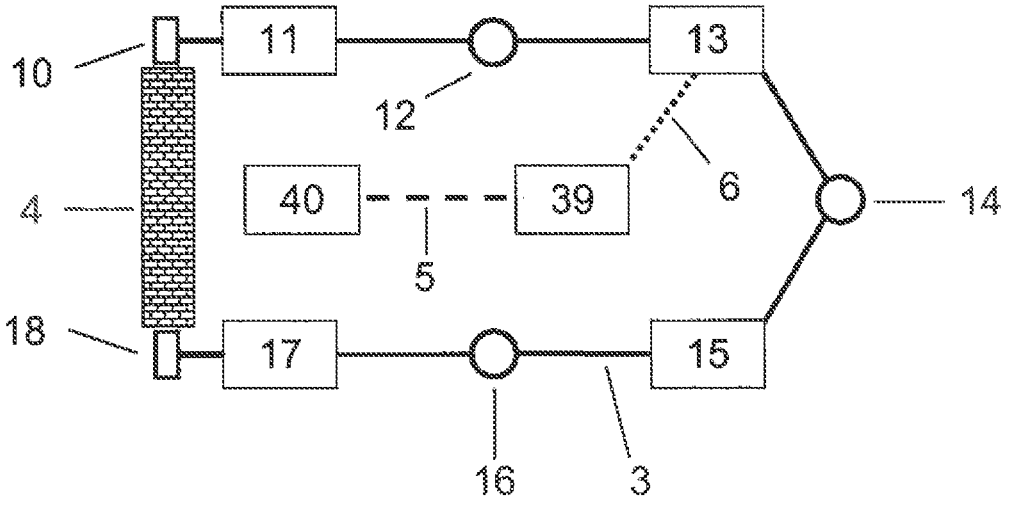
FIG. 3 shows another embodiment of a fence acccording to the invention forming an open loop and including an obstacle.

FIG. 3 shows a more complex embodiment in the form of an open loop (sequence) comprising four management units 11, 13, 15, 17 and three connection units 12, 14, and two terminal units 10, 18. The posts and the sensors are not shown. The function of the connection units is that of interconnecting two detector cables 3.

One of the management units 13 communicates with the concentrator, it is a gateway management unit. As in the examples above, the link 6 between the gateway management unit 13 and the concentrator 39 is provided for example via an RS485 interface and the link 5 between the concentrator 39 and the computer 40 is provided for example via RJ45 Ethernet.

Figure 4:
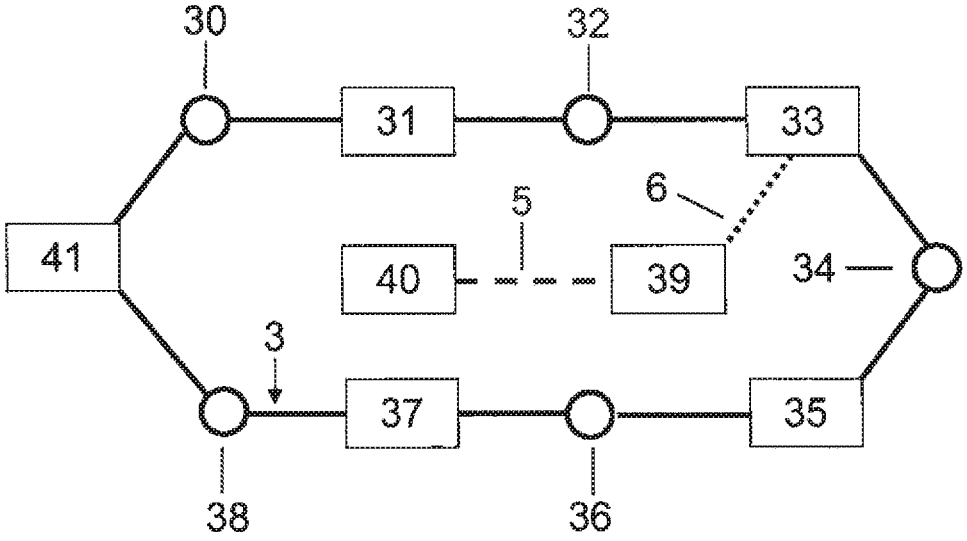
FIG. 4 shows a fence according to the invention, forming a closed loop with five management units.

FIG. 4 shows a further embodiment in the form of a closed loop (sequence) comprising five management units 31, 33, 35, 37, 41 and five connection units 30, 32, 34, 36, 38. The posts and the detectors are not shown. As in the examples above, the link 6 between the gateway management unit 33 and the concentrator 39 is provided for example via an RS485 interface and the link 5 between the concentrator 39 and the computer 40 is provided for example via RJ45 Ethernet.

Figure 5:
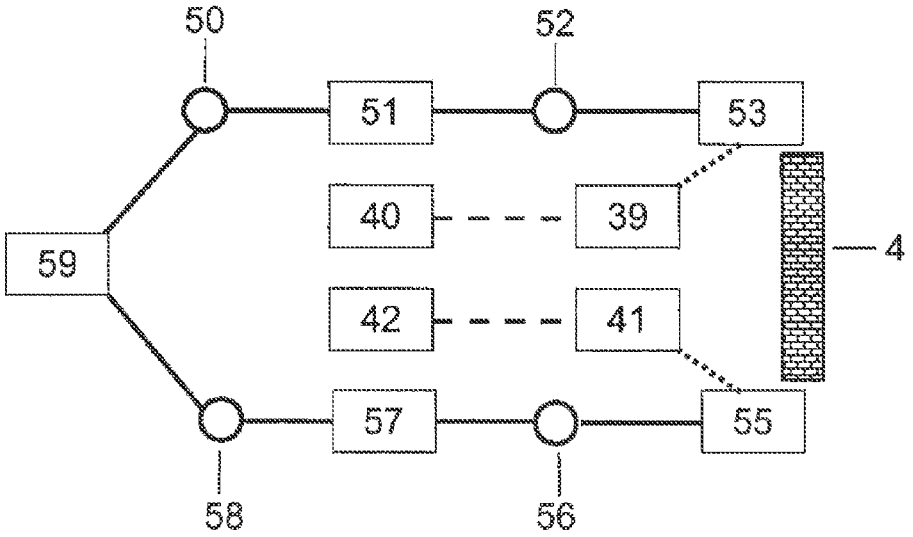
FIG. 5 shows a fence according to the invention, forming an open loop with five management units.

FIG. 5 shows a further embodiment in the form of an open loop comprising five management units 51, 53, 55, 57, 59, of which two are gateway management units 53, 55 (also acting in this case as terminal units, but which could add separate terminal units to extend the cable beyond the gateway management units), and four connection units 50, 52, 56, 58. Each gateway management unit 53, 55 communicates with the concentrator 39, 41 thereof which communicates with the microprocessor (computer) 40, 42 thereof.

Figure 6:
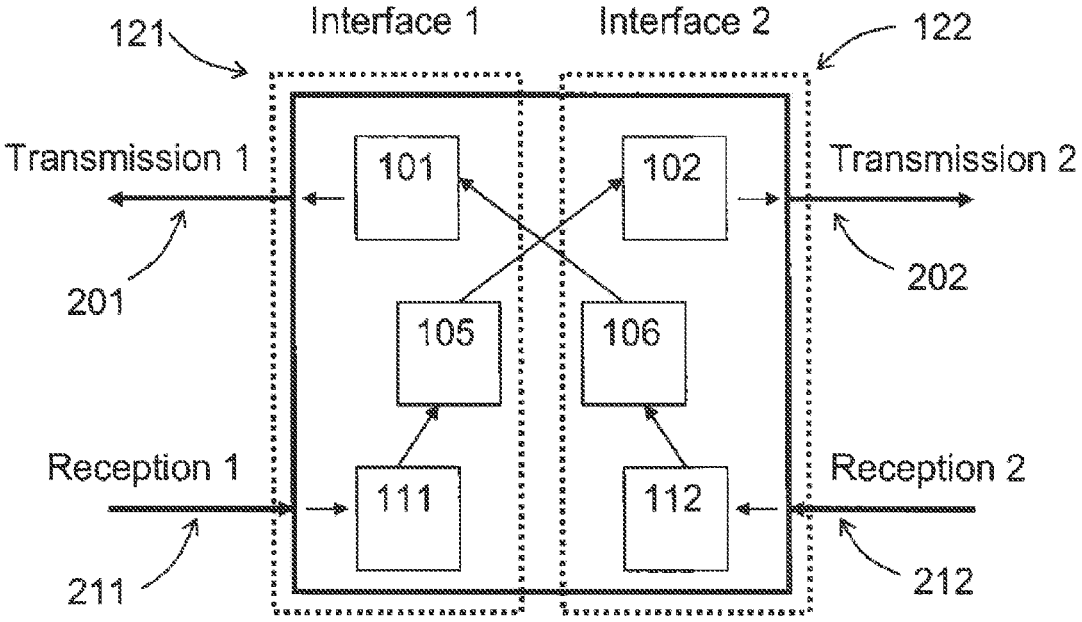
FIG. 6 shows an electrical diagram of a detector used in the invention.

FIG. 6 shows a part of the electrical diagram of an electronic board fitted in each detector and each management unit, i.e. the part of said board comprising the buffer memories. Each board has two interfaces 121, 122, one interface for each side. Each detector and management unit has six buffer memories suitable for storing a signal frame, i.e.:

(i) a first reception buffer memory 111, 112 for each interface 121, 122, wherein the byte or one of the bytes of the frame currently being received is stored;

(ii) a second transmission buffer memory 101, 102 for each interface 121, 122, wherein the byte or one of the bytes of the frame currently being transmitted is stored;

(iii) a third intermediate buffer memory 105, 106 for each interface 121, 122 which acts as a link between the reception channel on one side and the transmission channel on the other side.

More specifically, the signal received from the left side into the reception buffer memory 111 is transferred to the intermediate buffer memory 105 to be subsequently transferred to the transmission buffer memory on the right side 102, and vice versa, as indicated by the arrows in FIG. 6.

A management unit or a detector receiving a byte from a frame which is not solely intended for same transfers said byte immediately, without waiting for the end of the frame, to the buffer memory provided that said buffer memory is free.

A management unit or a detector having a byte in a buffer memory transmits same via the transmission channel, provided that the transmission channel is in idle mode, i.e. available.

Each interface 121, 122 may be part of a universal asynchronous transmitter-receiver (UART), given that it is also possible to use a DUART type component integrating two UARTs, or a microprocessor fulfilling the same function.

In further embodiments, said buffer memories may also store more than one byte, i.e. for example an entire frame.

FIG. 7 shows a further embodiment of a detection means according to the invention. It comprises a sensor 300, a microcontroller 310 fulfilling the function of two UARTs acting as interfaces 121, 122, two drivers 341, 342 such as RS232 drivers. The sensor 300 communicates in two directions with the microcontroller 310. The latter communicates in two directions with the drivers 341, 342, which are connected to the transmission channels 301, 302 and the reception channels 311, 312; they are electrically powered via a common power supply cable 321, 322 ("–" pole) and 331, 332 ("+" pole) connecting all the detection means from the same detector cable.

Alternatively, each detection means may be equipped with a standalone electricity supply (such as a photovoltaic cell connected to power storage means); this saves one of the two power supply wires 321, 322, given that a common ground 331, 332 is always required.

FIGS. 8 *a-c* show a detector according to the invention with the elongated housing 500 thereof and the cable 501. The housing 500 may be integrated in the cable 501 for example by molding, which ensures excellent tightness and satisfactory tensile strength on the cable if required. It is noted that the unit 500 is very compact: the main height F thereof is approximately twice the diameter of the sheath of the cable 501, the maximum height E is scarcely greater, and the depth R thereof is less than four times the thickness X of the sheath of the cable. The length L thereof is advantageously less than 100 mm. The compartment 520 wherein the electronic board is located with the sensor (as shown in FIG. 7) is protected by a thick layer of material, rendering the detector particularly robust.

According to the invention, each sensor has a specific identification address, which, in one advantageous embodiment, consists of three elements: the sequential number in the sequence or on the cable (typically 1 to 40 or 1 to 80), the address of the management unit to which it is connected (typically 1 to 15), and the number of the detector cable of the management unit to which it is connected, in the event of the same management unit controlling a plurality of individual cables (typically 1 or 2). These addresses are defined during site configuration.

In one embodiment, the cables are identical or merely differ by the number of detection means. The detection means bearing the sequential number n is always the nth detection means inserted in the cable, from the management unit to which it is connected, regardless of the cable; the identification address defined during configuration is used to differentiate two detection means bearing the same sequential number but situated on a different cable connected to the same management unit. In this way, the addressing of the detection means is independent from the site topology.

At regular intervals, the management unit transmits a query signal. This consists of a digital signal in the form of a byte frame. This frame comprises various individual elements, expressed by groups of bits, i.e.: a management element, a detector identification element, and a data element. Each of these elements is advantageously coded in 8 bits, and the remainder of the present description is based on this example, given that different encoding (in 16 bits, for example), or a different distribution is clearly envisaged within the scope of the present invention.

The management element comprises the address of the management unit (4 bits) generating the frame (for example 0 to 15) and a code (1 bit) representing the cable of the management unit whereon the frame is circulating (for example 0 and 1). It may also comprise a code associated with the function of the addressed device, coded in 3 bits.

The sensor identification element comprises the individual identification of the detector (for example 1 to 80, coded in 7 bits), which is incremented from one detector to another, and an element (coded in 1 bit) encoding the direction of movement of the frame (for example 0 outbound and 1 inbound).

The data element, coded in 8 or 16 bits, contains detector-specific data, for example a physical quantity measured by the sensor.

This signal (hereinafter referred to as a "frame", given that the full signal may comprise a sequence of a plurality of frames) is received by the first detector D1 in the sequence which adds the individual identification thereof. In one embodiment, for a given detector cable, this addition of the individual address thereof is accomplished by incrementing the element of the frame representing the individual identification of the detector, for example an element representing, at the start of the management unit, the number zero and thus changing to the number one after having been incremented by the detector D1.

Subsequently, the detector D1 transmits this frame along with the individual identification thereof to the two directly adjacent units thereof D2 and UG. D2 adds the individual identification thereof, for example it adds the full individual address thereof or replaces the individual address of D1 by the address thereof; in one embodiment, D2 increments the frame element representing the sequential number of the detection by one unit, this element thus adopts the value two.

After transmitting a first frame to the first detector D1 (and receiving a first frame from the first detector D1), the management unit UG transmits a second frame, and so on. In this way, signal frames are continuously transmitted, according to a rhythm set by the management unit UG, in both directions of the sequence. Preferably, each direction has specific signal transmission means, preferably a wire, but it may also consist of a radiofrequency channel.

At the end of the sequence, the final detector D(n+p) is connected to a so-called terminal unit, a preferably passive component which merely indicates to return the signal to the detector D(n+p−1) from which it was received, after adding the individual address thereof or incrementing the frame element, and after having changed the element coding the direction of movement of the frame. If the complete first frame is returned to the management unit, this frame bears a log of each of the individual detectors, and the value measured. For example, if the sequence is interrupted (for example cut) between the detectors D6 and D7, the signal returned by the detector D6 to the management unit UG will not have been incremented by the detectors D7 and those following. In this way, the management unit can locate the disruption between D6 and D7.

Some further details on the frame exchange are given hereinafter.

The transmission channel 301, 302 of an interface 121, 122 may be in four different statuses:

(i) "Idle" mode: the interface 121, 122 is waiting to transmit data. It enters this mode either at start-up, or at the end of the interval of two bytes between the end of the transmission of an acknowledgement frame and the transmission of a new frame, or at the end of the interval of 7 bytes between the end of the reception of an acknowledgement and a new frame. It exits the mode either by transmitting a new frame or by receiving a frame on the reception channel 311, 312 of the same interface 121, 122.

(ii) "Transmission" mode: the interface 121, 122 is transmitting data. It enters this mode when bytes ready to be transmitted are found in the transmission buffer memory. It exits this mode at the end of transmission of the bytes of a frame.

(iii) "End of Frame" mode: the interface 121, 122 has finished transmitting the bytes of a frame, given that it cannot transmit anything for the end of frame interval. It enters this mode at the end of the transmission of the bytes of a frame. It exits this mode at the end of the end of frame interval.

(iv) "Acknowledgement" mode: the interface 121, 122 is waiting to receive the acknowledgement of the final frame transmitted or is receiving a frame; in the meantime, it can only transmit acknowledgements. It enters this mode at the end of the end of frame interval or when it receives a frame on the reception channel 311, 312 of the same interface 121, 122.

The reception channel 311, 312 of an interface 121, 122 may be in three different statuses:

(i) "Idle" mode: the interface 121, 122 is waiting to receive data. It enters this mode either at start-up, or at the end of the end of frame interval. It exits this mode by receiving data.

(ii) "Reception" mode: the interface 121, 122 is receiving bytes, saved in a buffer memory (consequently, the transmission channel of the interface switches to Acknowledgement mode). It enters this mode on receiving data. It exits this mode when there is no activity on the reception channel thereof.

(iii) "End of Frame" mode: the interface 121, 122 is no longer receiving data. A period of inactivity (end of frame interval) marks the end of a frame. It enters this mode when there is no activity on the reception channel. It exits this mode at the end of the end of frame interval.

The interaction between a transmitter and a receiver (for example two detectors) is explained hereinafter in further detail in chronological order.

(i) A transmitter takes the initiative to transmit a frame. The reception channel of the receiver exits idle mode to run in reception mode. After detecting reception mode on the reception channel, the receiver measures the inactive time after each byte, and the transmission channel switches to acknowledgement mode.

(ii) A transmitter has sent all the bytes of the frame thereof. The transmitter transmission channel switches to end of frame mode and the reception channel detects the end of frame interval (3 bytes).

(iii) During the three-byte end of frame interval, the receiver processes the frame; if the frame is consistent, it transmits the acknowledgement. The transmission channel of the transmitter then switches to acknowledgement mode.

(iv) The receiver has transmitted the acknowledgement and, consequently, the transmission channel of the transmitter remains in acknowledgement mode for the 7-byte interval, and the transmission channel of the receiver remains in acknowledgement mode for the 2-byte interval.

Figure 9:
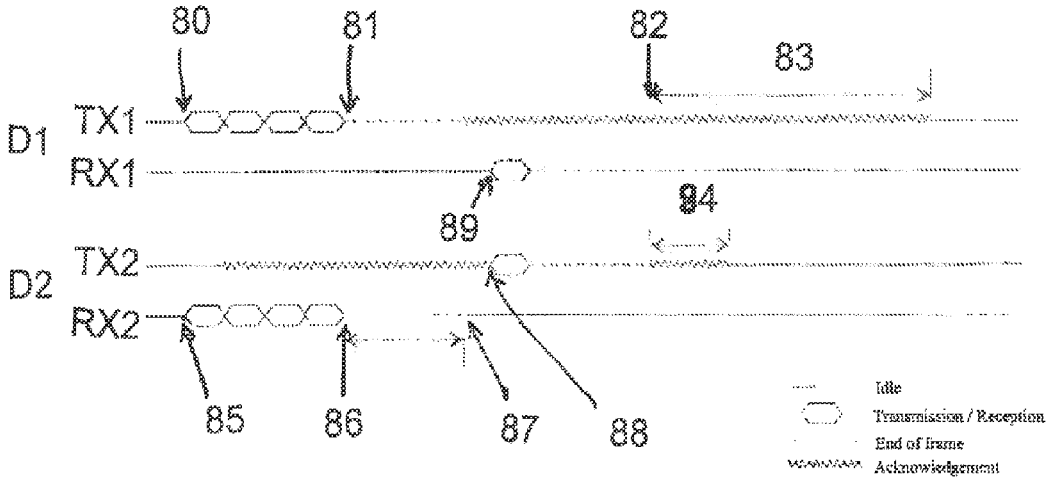
FIG. 9 shows a timing chart for signal transmission between two detectors used in the invention.

This interaction method between a transmitter and a receiver is illustrated in the timing chart in FIG. 9 showing the transmission of a frame from a detector D1 to a detector D2. The two reception and transmission channels are symbolized by RX and TX, respectively.

The reference 80 marks the start of transmission of the frame by D1 on the channel TX1 thereof.

The reference 81 marks the end of transmission of the bytes of the frame by D1; the channel TX1 is in "End of Frame" mode.

The reference 85 marks the detection by D2 on the channel RX2 of the frame; D2 switches the channel TX2 thereof to "Acknowledgement" mode.

The reference 86 marks the end of the frame received by D2; the end of frame is always followed by a three-byte interval.

The reference 87 marks the detection by D2 of the end of the frame received; D2 then starts processing the frame received.

The reference 88 marks, if the frame received is consistent, the transmission of the acknowledgement of the frame by D2; the end of the transmission of an acknowledgement frame is always followed by a two-byte "end of frame interval" (reference 84).

The reference 89 marks the start of the reception of the acknowledgement by D1 on the channel RX1 thereof.

The reference 82 marks the end of the reception of the acknowledgement by D1.

The end of frame interval between the reception of an acknowledgement and the transmission of a new frame is 7 bytes (reference 83).

The product according to the invention has numerous advantages. It enables auto-adaptation of the sensitivity thresholds according to the supporting member whereon the detector cable is installed (accounting for the ageing of the fence and the heterogeneous supporting members).

It is suitable for detecting and locating any attempted intrusions by cutting, climbing and extracting the fence wherein it is installed, while ignoring weather-related phenomena such as wind, hail, parasitic vibration (vehicle, etc.). For example, for a detector spacing of approximately 2.7 to 3 m, it is suitable for locating the intrusion with a precision of less than 3 m within a rectangle measuring 2.5 m wide and 4 m high; unlike some known products, it is suitable for locating cuts in the cable with a precision of less than 3 m. It prevents false alerts since it is suitable for differentiating between phenomena distributed along extra long distances (wind, rain, etc.) and those only having a local effect (attempted intrusion).

It is suitable for producing extra long fences, in the region of 3000 meters per unit. By multiplying the number of gateway management units, it is possible to produce even longer fences. Each unit may be subdivided into surveillance zones, for easier handling of alerts signaled by the remote station (P); programming these surveillance zones is simple and flexible.

The electrical power supply of the detector cable and the management units, using for example photovoltaic cells, is standalone and not dependent on an external power supply, simplifying installation since there is no need for civil engineering works to bury the cables. The product is not sensitive to weather-related disturbances.

A further advantage of the product according to the invention, particularly in relation to known systems using microphone cable detection, lies in the simplicity of the use thereof. The detector cable is highly resistant to bending, twisting and traction. This enables easy connection of the detector cable to the management units; indeed, it consists of standard electrical wiring, and there is no need to handle sensitive elements. The same applies for the insertion of openings (door, gate, turnstiles, etc.) where the detector may be readily extended with standard cable.

The maintenance and repairs on the fence are also simplified: only the damaged section needs to be replaced, since the electrical connections are standard, and it is not necessary to replace the entire cable as for some products according to the prior art.

One embodiment of the invention is illustrated in detail hereinafter.

1) Communication between detectors, particularly frame acknowledgement, is described hereinafter. When a detector receives a complete frame and the data format is consistent, it returns an acknowledgement frame to the transmitter. This acknowledgement enables the detector to determine whether it is dealing with a receiver capable of processing a frame; it is suitable for detecting a full communication buffer memory, an end of line or cut in the communication line.

If the detector is not capable of processing a frame received (for example because the buffer memory thereof is full), it returns an acknowledgement frame indicating that the transmitter should repeat the frame.

If a detector does not receive an acknowledgement following the transmission of a frame, it adapts the processing according to the frame and, in some cases, may return the frame.

2) Communication between the detectors and the management unit is described hereinafter. This communication should be suitable for configuring the cable, checking cable integrity, managing the operating modes, reporting sensor events and factory testing.

2.1 Cable Configuration 2.1.1 Addressing the Detectors

Each detector is identified uniquely on a site with an address. The address consists of the address of the sensor on the cable (for example 1 to 40), the address of the management unit to which it is connected (for example 0 to 15) and the number of the detector cable of the management unit to which it is connected (for example 1 or 2). This information circulates on the cable with query type ("watchdog") frames in detection mode or test type frames in test mode. These frames are transmitted by the management units at regular intervals.

The address of the detector on the cable is the counter. It is set to 0 by the management unit generating the frame and is incremented from one detector to another. The address of the detector is: counter received+1.

The address of the management unit and the number of the detector cable are written in the frame by the management unit generating the frame.

When a detector receives one of these frames, it compares the information from the frame to its own and updates in the event of a difference. This operating principle makes it possible to set a blank cable and reconfigure a modified or moved cable.

2.1.2 Modifying a Detector Detection Threshold

It is possible, using a management unit in configuration mode, to modify the detection threshold of any of the detectors connected thereto. The user can, using the management board interface, set a threshold modification: increase, decrease, range of modification. After confirming that the user has entered a threshold modification, the management unit checks that it is indeed managing the selected sensor and generates a threshold modification frame.

If it is not managing the selected detector, the interface reports this to the user.

This frame circulates from one detector to another until it reaches the detector in question or an end of line or a communication problem.

2.2 Checking Cable Integrity

Cable integrity is checked at regular intervals with a query type frame in detection mode or a test type frame in test mode. Each management unit has a specific time delay per cable. It is reloaded following each reception of a query type or test type frame. Regularly before the time delay has elapsed, the management unit generates one of these frames. The frame circulates from one sensor to another, up to a management unit, an end of line sensor or a communication error. It is then returned to the sender and carries information on the conditions of the return.

The return frame analysis makes it possible to determine:

With the counter: the number of detectors on the cable recognized by the management unit.

With the data: if the final unit on the cable recognized by the management unit is envisaged to be at the end of a line (detector configured at end of line or other management unit). If the final unit is indeed envisaged to be at the end of a line, it returns the type and address thereof.

With this information, a management unit can detect and locate a system malfunction.

2.3 Operating Mode Management

Two operating modes are possible: "detection" mode and "test" mode. The user selects the operating mode using the management unit board interface. In one advantageous embodiment, when the management unit box is closed, "detection" mode is automatically selected. "Test" mode makes it possible to switch on an indicator light (LED for example) on the detectors on detecting an impact and switch on an "alarm" indicator light on the management board following an alarm. It is also suitable for manually setting the detector detection threshold.

"Test" mode runs on a management unit cable wherein the end communication pair is short-circuited.

The choice of operating mode is indicated to the detectors with the query type and test type frames. When the selected operating mode is "detection", the management unit regularly transmits a query type frame. When the operating mode is "test", the management unit regularly transmits a test type frame.

2.4 Reporting Detector Events

The detectors transmit information to the surrounding management units when they detect an event: intrusion or technical fault. For this purpose, they use the "sensor event" frame. The frame is systematically transmitted in both directions of the cable. These frames circulate from one detector to another until they encounter a management unit. The management units filter the information.

An event does not systematically trigger an alarm. Events are systematically located. They may consist of:

- detection of a physical signal by the detector (for example a vibration): the detector transmits the specific parameter(s) of the signal (in the case of vibration, the intensity of the amplitude along each axis),
- failure of a self-test on powering up a detector,
- detection of a detector power supply voltage which is too low.

2.5 Factory Test

The factory test makes it possible to check the proper operation of the detectors. When operators wish to conduct such a test, they transmit a "factory test" type frame from a special management unit. A sensor receiving a "factory test" frame runs a self-test; if this self-test is conclusive, it transmits the frame to the adjacent unit (and the indicator light thereof lights up). Factory test mode can only be exited by switching off the detector. This test is suitable for testing a detector on its own or an entire cable.

In one advantageous embodiment, if the indicator lights of the first and final detectors of a cable are on, all the sensors of the cable are operating correctly. On the other hand, if, from a detector, the indicator lights are not switched on, the first detector for which the indicator light is off has a problem.

3) Communication between a management unit and a gateway management unit is described in detail hereinafter.

A management unit has a plurality of sources of information potentially giving rise to an alarm frame: (i) the alarms thereof (battery voltage, auxiliary inputs, self-shielding), (ii) technical faults of the detection means (low power supply voltage, self-test), and (iii) signals detected by the detection means, particularly following vibration of the fence. The alarms (i) and (ii) are referred to as "technical alarms" and the alarms (iii) as "intrusion alarms" herein.

The management unit filters this information and generates an alarm frame if required. The alarm frame contains the information required for the concentrator (operation, monitoring, log). The filters include: a filter for the intrusion alarm (particularly the triggering and inhibition conditions) and a filter for the technical alarms, intended to avoid triggering this alarm for a low detection means failure rate.

The alarm frame is transmitted in both direction; the gateway management unit is programmed to transmit same to the concentrator.

The alarm frame comprises three groups coded in 8 bits.

A first group comprises a function code (3 bits), differentiating this function from the others, the address of the management unit (4 bits, the value being typically between 0 and 15) and the identification of the management cable to which the detector in an intrusion alarm status belongs (1 bit, the value being typically between 1 or 0).

A second group comprises an information code on the alarm (1 bit, the value being 1 for the appearance of the alarm, and 0 for the disappearance thereof), a code on the alarm type (1 bit, the value being 0 for an intrusion alarm and 1 for a technical alarm) and the address of the sensor in the alarm status (6 bits, the value being typically between 1 and 40).

The third group comprises data relating to the alarm (8 bits). The encoding thereof is dependent on the nature of the alarm (alarm on a management unit, technical alarm transmitted by a detector (self-test error, insufficient power supply voltage or cable cut) or intrusion alarm transmitted by a detector (in this case, it comprises the physical parameter(s) measured by the sensor, for example the maximum amplitude measured).

This frame is transmitted by a management unit after processing information given by the detectors and the management unit and on each change of alarm status. It circulates in the direction of the final concentrator to perform a site configuration. It circulates on the network until it encounters a management unit connected to a concentrator. A management unit which has detected a cut in the cable thereof returns the frame.

4) Communication between the gateway management unit and the concentrator is described hereinafter.

4.1 Site Configuration

The site configuration frame is suitable for transmitting information on the installation layout to the concentrator.

4.1.1 Configuration Query

This frame is generated by a gateway management unit on request by the user to update the system configuration information.

The frame is transmitted by the gateway management unit and circulates along the detector cables from one management unit to another until it encounters an end of line or returns to the gateway management unit generating same via the other cable.

The "Site configuration query" frame comprises two groups coded in 8 bits.

A first group comprises a function code (3 bits), differentiating this function from the others, the address of the management unit generating the query (4 bits, the value being typically between 0 and 15) and an order code (1 bit, the value being typically 0 or 1).

A second group comprises two empty bits and a query/response code (1 bit, value 0), a code identifying the cable of the gateway management unit from which the frame was sent (1 bit) and a counter code for the number of management units previously receiving the order (4 bits, the value being typically between 0 and 15).

These two bytes may be followed by one or a plurality of null bytes.

A management unit receiving this query responds with a "Configuration response" frame. The counter is incremented by each management unit and is copied into the response. It is suitable for determining the order of the management units on the cable. The configuration query may be transmitted at any time by the user, regardless of whether the installation is complete.

4.1.2 Configuration Response

The management units receiving the query transmit a "Configuration response" frame to the cable via which the query arrived. The information contained in the responses enable the concentrator to construct a map of the system.

The "Configuration response" frame comprises five groups coded in 8 bits.

A first group comprises a function code (3 bits), differentiating this function from the others, the address of the management unit generating the query (4 bits, the value being typically between 0 and 15) and an order code (1 bit, the value being typically 1 or 0).

A second group comprises an empty bit and a query/response code (1 bit, value 1), a code (1 bit) identifying the cable of the responding management unit through which the query arrived, a code identifying the cable of the gateway management unit from which the query (1 bit) was sent, an incremented query counter code (4 bits).

A third group comprises the address of the responding management unit (4 bits) and 4 empty bits.

A fourth group comprises the number of detectors on the first cable along with information on the end of line (end of line cable or connection fault); a fifth comprises the same information for the second cable.

This frame enables the concentrator to construct the layout of the system on the basis of the following information: addresses of the management units, order of the management units on the cable (counter), number of the cables connecting the management units (response UG cable, gateway UG cable), number of detectors on the cables.

4.2 Status Transmission

The concentrator may, if required, request all the management units of a site to transmit the status thereof. The query is sent to the management unit to which it is connected in a "query" type response.

The management unit transmits the query on the two cables thereof. It circulates along the cable to an end of line or the return to the concentrator gateway management unit via the other cable. The management units receiving a status transmission query return the alarm frames required for the concentrator to update the alarm data thereof.

The "Status transmission query" frame comprises a group coded in 8 bits, comprising a function code (3 bits), the address of the management unit generating the query (4 bits, the value being typically between 0 and 15) and an order code (1 bit, value 1). This byte may end with one of a plurality of null bytes.

5) The structure of the frame for the various communication scenarios is described in detail hereinafter.

5.1 Frame Between Two Detectors

The "acknowledgement" frame comprises a function code (3 bits) and data (5 bits). The data adopt the value 0 when a sensor having received a frame declares that it is capable of processing same; it then becomes responsible for the correct routing of this frame to the next detector. The data adopt the value 1 when a detector having received an acknowledgement signaling that the next detector is present cannot process the frame and repeats it.

A management unit manages this frame in the same way as for a detector.

5.2 Frames Between Detector and Management Unit 5.2.1 Query ("Watchdog") Frame

This frame is used for checking the integrity of the link between a management unit and the end of line (other management unit or end of line detector) and dynamically addressing the detectors in detection mode. It is transmitted periodically by a management unit and circulates from one detector to another until it encounters a configured end of line detector (provided with a terminal unit), another management unit or a communication problem. It is then returned toward the management unit having generated the frame with information for checking whether the line is intact or not.

The query frame comprises three groups coded in 8 bits.

A first group comprises a function code (3 bits), the address of the management unit (4 bits, the value being typically between 0 and 15) and the identification of the cable of the management unit whereon the frame circulates (1 bit, the value being typically 0 or 1).

A second group comprises an "outbound/return code" identifying the direction of movement of the frame on the cable (1 bit, the value being typically 0 for the "outbound" direction and 1 for the "return" direction), and the address of the detector (7 bits, the value being typically between 1 and 80). In one advantageous embodiment, if the outbound/return code is 0, the address of the detector is incremented from one detector to another, and if the outbound/return code is 1, the address of the counter remains set at the return value.

The third group comprises data (8 bits) on the module (detector, management unit) transmitting the frame.

The counter is suitable for addressing the detectors dynamically. It is incremented on receiving the frame. The sensor updates the address thereof if required if the addressing bit is 0. The addressing bit is suitable for not modifying the addresses of the detectors situated on the cable of the management unit opposite that generating the frame.

5.2.2 Detector Event Frame

This frame is generated by a detector. It is transmitted by the detector in both directions and circulates from one detector to another up to a management unit or an end of line. It is coded in three groups of bits.

The first group, coded in 8 bits, comprises a function code, followed by a code for the address of the management unit on which the detector is dependent (4 bits, adopting for example the value 0 to 15), and one bit representing the cable of the management unit on which the detector is dependent.

The second group, coded in 8 bits, comprises a bit coding the alarm type (event or technical fault), a bit not in use, and the address of the detector generating the frame (6 bits, adopting for example the value 1 to 40 in the case of 40 detectors).

The third group, coded in 16 bits, represents the data containing information on the alarm.

If the alarm type is "event", these data contain the parameters and values measured by the sensor. For an accelerometer, this consists of the amplitude of the three axes of the sensor during the event, distributed in 16 bits.

If the alarm type is "technical fault", these data code the source of the technical fault (for example: self-test error of the sensor, insufficient power supply voltage, i.e. less than a predefined threshold). Preferably, the technical faults are filtered by the management unit: a certain number of detectors in technical fault status are required to trigger an alarm.

5.2.3 Frame in "Test" Mode

This replaces the query frame during the test mode. It is transmitted periodically by a management unit to one of the cables thereof. The frame is returned once it encounters an end of line detector, a management unit or a communication problem. It is transmitted once the management board enters test mode and the sensors receiving same enter test mode. The management board stops the transmission of this frame on exiting test mode. The management unit then re-transmits a query frame and the detectors exit test mode.

This frame comprises three groups of eight bits.

The first group comprises a function code (3 bits), the address of the management unit generating the frame (4 bits) and the address of the cable whereon the frame is circulating (1 bit).

The second group comprises an "outbound/return code" identifying the direction of movement of the frame on the cable (1 bit, the value being typically 0 for the "outbound" direction and 1 for the "return" direction), and the address of the detector (7 bits, the value being typically between 1 and 80).

The third group comprises data (8 bits) on the module (detector, management unit) transmitting the frame.

5.2.4 Threshold Modification Frame

This frame is transmitted by a management unit when the user wishes to modify the threshold of a detector in test mode. It circulates on a cable of a management unit and stops when it encounters the detector in question or an end of line.

This frame comprises three groups of eight bits.

The first group comprises a function code (3 bits), the address of the management unit generating the frame (4 bits) and the address of the cable whereon the frame circulates (1 bit).

The second group comprises a bit adjusting the detection threshold (the value 0 indicates an incrementation, the value 1 decrementation, for example), and the address of the detector (6 or 7 bits, the value being typically between 1 and 80, given that a special address is provided forcing all the sensors to take control at the same time), and optionally an (eighth) empty bit.

The third group comprises data relating to the amplitude (8 bits) of the signal measured by the sensor.

5.2.5 Factory Test Frame

When a detector receives a factory test frame, it runs a self-test procedure. If the self-test is conclusive, the detector transmits the frame to the next sensor and switches on the indicator light (LED). The detector can only exit factory test mode by switching off.

The invention claimed is:

1. A method for detecting and locating a cut in a detection cable having a plurality of detection means (Dn), preferably identical, and preferably with spacing between two adjacent detection means which is substantially equal, connection means at each of both ends thereof, each detection means preferably being a shock and/or vibration detector, and each detection means comprising two interfaces (121, 122), one on each side of the detection means, wherein each detection means (Dn), each of said interfaces (121, 122) has a transmission channel (201, 202) and a reception channel (211, 212) suitable for transmitting and receiving data to (or from) another detection means (Dn+1 or Dn−1) or to (or from) a management unit (UG) to which said detection means (Dn) is, in operation, directly connected, and in that each of said interfaces (121, 122) comprises at least three buffer memories (101, 105, 111; 102, 106, 112) suitable for storing at least one byte of the signal frame, wherein:

a first reception buffer memory (111, 112) for each interface (121, 122), wherein the byte or one of the bytes of the frame currently being received is stored;

a second transmission buffer memory (101, 102) for each interface (121, 122), wherein the byte or one of the bytes of the frame currently being transmitted is stored;

a third intermediate buffer memory (105, 106) for each interface (121, 122) which acts as a link between the reception channel (211, 212) on one side and the transmission channel (202, 201) on the other side;

wherein, the method comprises the steps:

the management unit (UG) periodically transmits a query in the form of at least one byte frame (referred to as a "query frame") to the detection means to which it is directly connected;

each detection means (Dn) transmits this query frame to the next adjacent unit, which may be either another detection means (Dn+1) or a management unit (UG), or a terminal unit;

in response to the query, the management unit (UG) expects to receive the same query frame as that transmitted and comprising the sequential number of the last detection means belonging to the detection cable connected to the management unit (UG), the reception of said at least one query frame by said next adjacent unit of said detection means (Dn) triggers the transmission of an acknowledgement frame to the sender;

if the detection means (Dn) has not received the acknowledgement frame from the next adjacent unit (Dn+1) thereof, said detection means (Dn) transmits the query frame received to the preceding adjacent unit (Dn−1) and the management unit (UG) finally receives the same query frame as that transmitted, but observes that the sequential number of said query frame is in this case (Dn) and not the sequential number of the last detection means of the cable;

the management unit UG then decides that the cable is cut between the detection means (Dn) and the detection means (Dn+1).

2. The method according to claim 1, wherein said management unit (UG) is contained in a system for detecting and locating an attempted intrusion into a perimeter defined by a fence, said fence comprising retention elements and ground securing elements such as posts, said detection and location system further comprising:

a plurality of means (D) for detecting impacts and/or vibrations liable to occur on said fence, interconnected via the detection cable that is connected to said management unit (UG), a station (P) for processing data connected to at least one of said management units (UG), means for transmitting data from at least one of said management units (UG) to the data processing station (P), optionally, one or a plurality of terminal units (T) for terminating a free end of said detection cable, wherein:

each detection means (Dn) is directly connected (optionally via a connection unit) on one side to another detection means (Dn+1 or Dn−1) and on the other side, either to another detection means (Dn+1 or Dn−1), or to a management unit (UG), or to a terminal unit (T); and each detection means (Dn) transmits data in digital signal frame format to the detection means (Dn+1 and/or Dn−1) and/or to the management unit (UG) to which it is directly connected;

each detection means (Dn) receives data in digital format from the detection means (Dn+1 and/or Dn−1) and/or to the management unit (UG) to which it is directly connected; and a detection means (Dn) that receives data on one side transmits said data to the detection means (Dn+1 or Dn−1) or management unit (UG) to which it is directly connected on the other side; and each detection means (Dn) transmits data in digital format about events that it has detected to the detection means (Dn+1 or Dn−1) or management unit (UG) to which it is directly connected.

3. The method according to claim 2, wherein:

the management unit (UG) transmits a query signal in byte frame format (referred to as a "query frame") at regular intervals to the detection means (D1) to which it is directly connected, said detection means (D1) adds, after receiving said frame, the individual identification thereof, and transmits same to the detection means (D2) and the management unit (UG) to which it is directly connected.

4. The method according to claim 3, wherein said query frame comprises:

a management element, comprising the address of the management unit generating the frame and a code representing the cable of the management unit whereon the frame is circulating;

a detection means identification element for the individual identification thereof, which is incremented when said frame is transmitted from one detection means (Dn) to the adjacent means (Dn+1 or Dn−1), an element coding the direction of movement of the frame, a data element containing the specific data of the detection means, such as a physical quantity measured by said detection means.

5. The method according to claim 4, wherein said frame, when it has been transmitted by the final detection means (D(n+p)) of said detection cable to a terminal unit (T) directly connected to said final detection means (D(n+p)), is returned to said final detection means (D(n+p)), which then, after loading the status of the element coding the direction of movement of said frame, returns said frame to the detection means (D(n+p−1)) to which it is directly connected.

6. The method according to claim 2, comprising a plurality of detection cables, which are identical or different, each comprising a plurality of impact and/or vibration detection means (Dn).

7. The method according to claim 2, wherein a direct data link between the detection means (Dn) and the management unit (UG) only exists for the detection means directly connected to the management unit (UG).

8. The method according to claim 2, wherein each detection means (Dn) comprises a detector, and two interfaces (121, 122), one on either side of the detection means, each of these interfaces (121, 122) having a transmission channel (201, 202) and a reception channel (211, 212) for receiving and transmitting data from another (or to another) detection means (Dn+1 or Dn−1) or from (or to) a management unit (UG) to which said detection means (Dn) is directly connected, each of said interfaces (121, 122) comprising at least three buffer memories (101, 105, 111; 102, 106, 112) suitable for storing at least one byte of the signal frame, namely:

a first reception buffer memory (111, 112) for each interface (121, 122), wherein the byte or one of the bytes of the frame currently being received is stored;

a second transmission buffer memory (101, 102) for each interface (121, 122), wherein the byte or one of the bytes of the frame currently being transmitted is stored;

a third intermediate buffer memory (105, 106) for each interface (121, 122) which acts as a link between the reception channel (211, 212) on one side and the transmission channel (202, 201) on the other side.

9. The method according to claim 8, wherein the frame, byte by byte, received by the reception channel (211) is received in the reception buffer memory (111), transferred to the intermediate buffer memory (105) acting as a link with the transmission channel and then transferred to the transmission buffer memory (102) to be transmitted by the transmission channel (202).

10. The method according to claim 2, wherein each detection means is identified uniquely with an address, said address consisting of the sequential number of the detection means on the cable, the address of the management unit to which it is connected, and the number of the detection cable of the management unit to which it is connected.

11. The method according to claim 2, wherein:

each detection means (Dn), detecting motion in relation to the fence using the integrated sensor, spontaneously generates a frame referred to as an event frame which is transmitted to each of the direct adjacent units thereof, wherein the next (Dn+1) and previous (Dn−1) detection means or to the detection means (Dn+1) and to the management unit (UG) or to the detection means (Dn−1) and to the management unit (UG), said event frame comprising at least one parameter Z which is a representation of at least one physical parameter measured by the sensor of said detection means (Dn);

the management unit (UG) to which the detection cable is connected comprising the detector(s) having transmitted the event frame thereof analyzes the set of event frames received and decides whether to generate an alarm frame, given that the precise location of the event is determined by the number of the detector having generated the maximum value of said parameter Z.

12. The method according to claim 2, comprising one or a plurality of terminal units for terminating a free end of said detection cable.

13. The method according to claim 1, wherein the cable comprises not more than 80 detector means, and more specifically not more than 40 detection means.

14. The method according to claim 1, wherein each detection means is contained in an elongated sealed housing, the length whereof is parallel with the cable.

15. The method according to claim 14, wherein said housing is integrated in a sheath of the cable.

16. The method according to claim 1, wherein the next adjacent unit is a terminal unit.

* * * * *